US012037875B2

(12) United States Patent
Clark et al.

(10) Patent No.: US 12,037,875 B2
(45) Date of Patent: Jul. 16, 2024

(54) COILED TUBING HEATING HEAD TOOL

(71) Applicant: Capital Oil Tools, Inc., Houma, LA (US)

(72) Inventors: Joseph Clark, Kilgore, TX (US); Joseph O'Connor, Henderson, TX (US); Cory Kohut, Cypress, TX (US); Ledif Basanta, Missouri City, TX (US); Yari Basanta, Missouri City, TX (US)

( * ) Notice: Subject to any disclaimer, the term of this patent is extended or adjusted under 35 U.S.C. 154(b) by 198 days.

(21) Appl. No.: 17/874,208

(22) Filed: Jul. 26, 2022

(65) Prior Publication Data

US 2023/0035315 A1 Feb. 2, 2023

Related U.S. Application Data

(60) Provisional application No. 63/203,643, filed on Jul. 27, 2021.

(51) Int. Cl.

| | |
|---|---|
| ***E21B 37/00*** | (2006.01) |
| ***E21B 34/10*** | (2006.01) |
| ***E21B 36/04*** | (2006.01) |

(52) U.S. Cl.

CPC ..... *E21B 37/00* (2013.01); *E21B 34/10* (2013.01); *E21B 36/04* (2013.01)

(58) Field of Classification Search

CPC ..... E21B 34/10; E21B 36/04; E21B 36/00; E21B 36/005; E21B 36/006

See application file for complete search history.

(56) References Cited

U.S. PATENT DOCUMENTS

| | | | | |
|---|---|---|---|---|
| 1,383,777 A * | 7/1921 | James | E21B 36/04 174/136 |
| 1,516,836 A | 2/1923 | Williamson | |
| 1,681,523 A | 3/1927 | Downey | |
| 2,076,308 A * | 4/1937 | Wells | E21B 36/00 166/300 |
| 4,125,761 A | 11/1978 | Churchill | |
| 4,266,605 A * | 5/1981 | LaBorde | E21B 33/072 166/97.1 |
| 4,759,406 A | 7/1988 | Smith | |
| 5,168,929 A | 12/1992 | Galloway | |

(Continued)

FOREIGN PATENT DOCUMENTS

WO 2018138479 A1 8/2018

OTHER PUBLICATIONS

Dalton WATT-FLEX Cartridge Heaters; www.daltonelectric.com.

(Continued)

*Primary Examiner* — Tara Schimpf
*Assistant Examiner* — Yanick A Akaragwe
(74) *Attorney, Agent, or Firm* — Bradley Arant Boult Cummings LLP; Henry L. Ehrlich

(57) ABSTRACT

A coiled tubing heating head tool system includes a tool connected at a connector to a terminal end of coiled tubing, the tool having a tubular extending from the connector to a heating head having a heater, a fluid passage extending from a discharge port in the tubular through the connector into the coiled tubing, and a one-way valve in the fluid passage between the discharge port and the connector, and a power cable electrically coupled to the heater and extending through the tubular, the connector, and the coiled tubing, to an electrical power source.

20 Claims, 4 Drawing Sheets

(56) References Cited

U.S. PATENT DOCUMENTS

| | | | | |
|---|---|---|---|---|
| 5,539,853 | A | 7/1996 | Jamaluddin et al. | |
| 7,861,786 | B2 | 1/2011 | Hill, Jr. et al. | |
| 9,982,514 | B2 | 5/2018 | Landry et al. | |
| 10,794,125 | B2 | 10/2020 | Clark | |
| 2007/0151735 | A1 | 4/2007 | Ravensbergen et al. | |
| 2008/0066920 | A1* | 3/2008 | Allcorn | E21B 41/0078 166/312 |
| 2008/0271893 | A1 | 11/2008 | Hill et al. | |
| 2021/0324697 | A1* | 10/2021 | Cardno | E21B 36/006 |
| 2023/0383620 | A1* | 11/2023 | Ridner | E21B 37/00 |

OTHER PUBLICATIONS

Wells Hot Rod(TM) A Better Way to Remove Paraffin and Cure Scale; www.welsinc.com/home/tool.

International application No. PCT/US2022/038448, International Preliminary Report on Patentability and Written Opinion of the International Searching Authority, Dec. 2, 2022.

* cited by examiner

COILED TUBING HEATING HEAD TOOL

BACKGROUND

This section provides background information to facilitate a better understanding of the various aspects of the disclosure. It should be understood that the statements in this section of this document are to be read in this light, and not as admissions of prior art.

Petroleum crude oil contains many constituents that can precipitate from the crude as it moves from the producing formation to the wellhead. One of those constituents is paraffin. The accumulation of paraffin within the production tubing of a working oil well is a major problem experienced throughout the petroleum industry. While the paraffin content of crude oil is variable, virtually all petroleum contains some paraffin that can result in the solidification of paraffin within the production tubing as the produced fluids travel from a downhole producing zone to the surface termination of the production tubing at a wellhead. As the buildup of solidified paraffin along the production tubing progresses, the ability to produce fluids through the tubing diminishes and eventually, in the worst case, the production tubing may become plugged to the point of preventing any flow of fluids. Plugging of the production tubing with substances found in the produced fluids, including paraffin deposits, requires servicing of the well for removal of the deposits before production of fluids can be resumed.

While paraffin may occur in most petroleum crude oil, the paraffin in each crude oil may have different characteristics and, in particular, may have a different melting temperature (or cloud point temperature). The temperature and pressure conditions will change along the passage of fluids from the producing zone within the formation through production tubing and the paraffin may solidify on the production tubing as the fluid cools in its path to the wellhead.

For example, a typical oil well temperature profile may show a temperature of 200 degrees Fahrenheit at 12,000 feet of depth, a temperature of 170 at 7,000 feet, and a continued temperature reduction to the wellhead. If the produced fluids passing upward through the tubing in such a well contains paraffin having a cloud point lower than 170 degrees, it becomes possible for paraffin deposits to accumulate along the inner wall of the tubing at any location where the temperature is lower than 170 degrees. Continued accumulation of deposits could cause the production tubing to become blocked.

SUMMARY

An exemplary heating head tool include a heating head having a heater, a tubular extending from the heating head to a tubing connector, a fluid passage extending from the tubing connector to a discharge port in the tubular, a one-way valve in the fluid passage, and a power cable electrically coupled to the heater and extending through the tubular and the tubing connector.

An exemplary coiled tubing heating head tool system includes a tool connected at a connector to a terminal end of coiled tubing, the tool having a tubular extending from the connector to a heating head having a heater, a fluid passage extending from a discharge port in the tubular through the connector into the coiled tubing, and a one-way valve in the fluid passage between the discharge port and the connector, and a power cable electrically coupled to the heater and extending through the tubular, the connector, and the coiled tubing, to an electrical power source.

An exemplary method includes deploying a tool on coiled tubing into a flowline, the tool comprising a tubular extending from a connector secured to the coiled tubing, a tubular extending from the connector to a heating head comprising a heater, a fluid passage extending from a discharge port in the tubular through the connector into the coiled tubing, a one-way valve in the fluid passage between the discharge port and the connector, and a power cable electrically coupled to the heater and extending through the tubular, the connector, and the coiled tubing, to an electrical power source; heating the heater with the power source; melting a deposit in the flowline in response to heating the heater; and pumping a fluid from the coiled tubing through the fluid passage and the discharge port into the flowline.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure.

DETAILED DESCRIPTION

Figure 1:
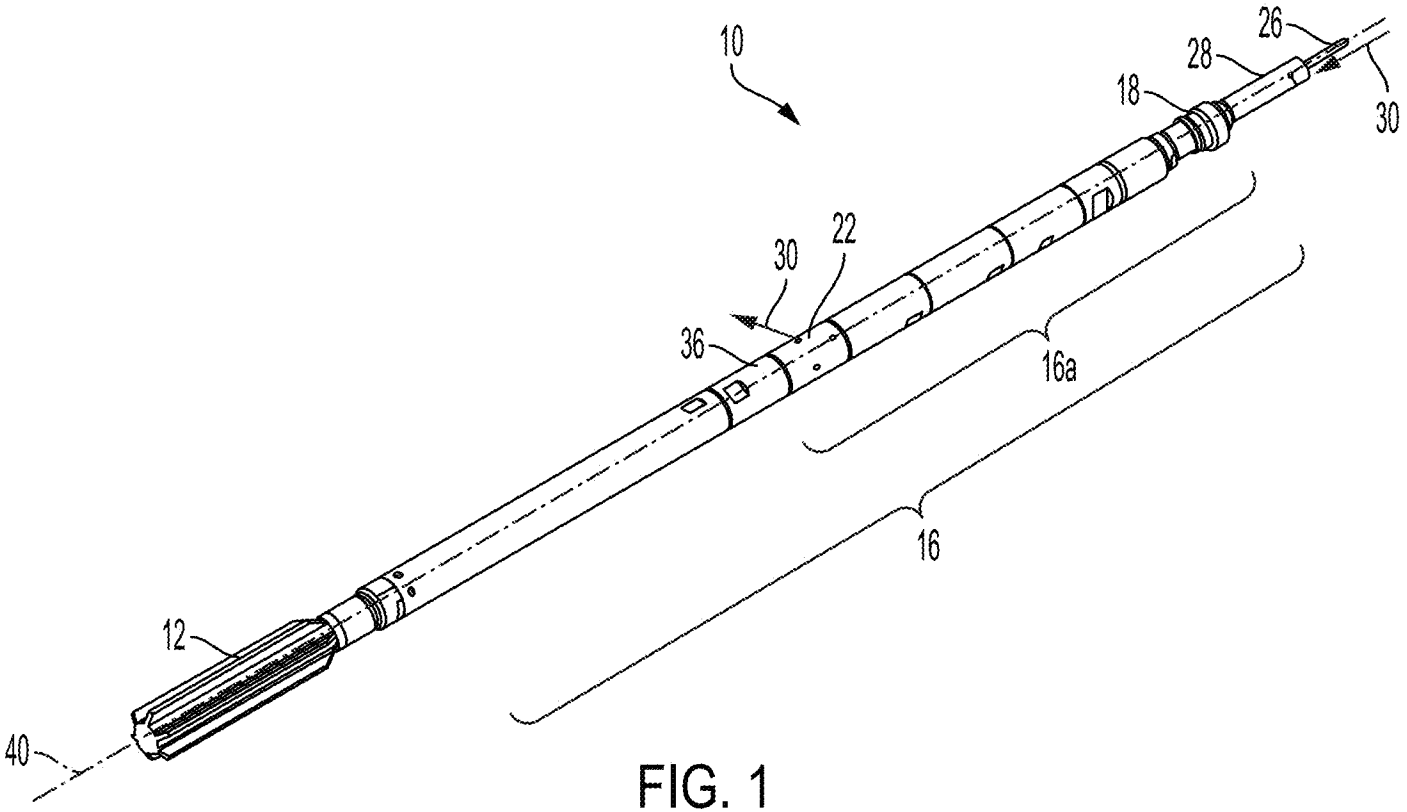
FIG. 1 illustrates an exemplary coiled tubing heating head tool according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Although relative terms such as "outer," "inner," "upper," "lower," and similar terms have been used herein to describe a spatial relationship of one element to another, it is understood that these terms are intended to encompass different orientations of the various elements and components in addition to the orientation depicted in the figures. Additionally, as used herein, the term "substantially," "about," "generally," and similar terms are used as terms of approximation and not a terms of degrees, and are intended to account for the inherent deviations in measured and calculated values that would be recognized by a person of skill in the art. Furthermore, as used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

Figure 2:
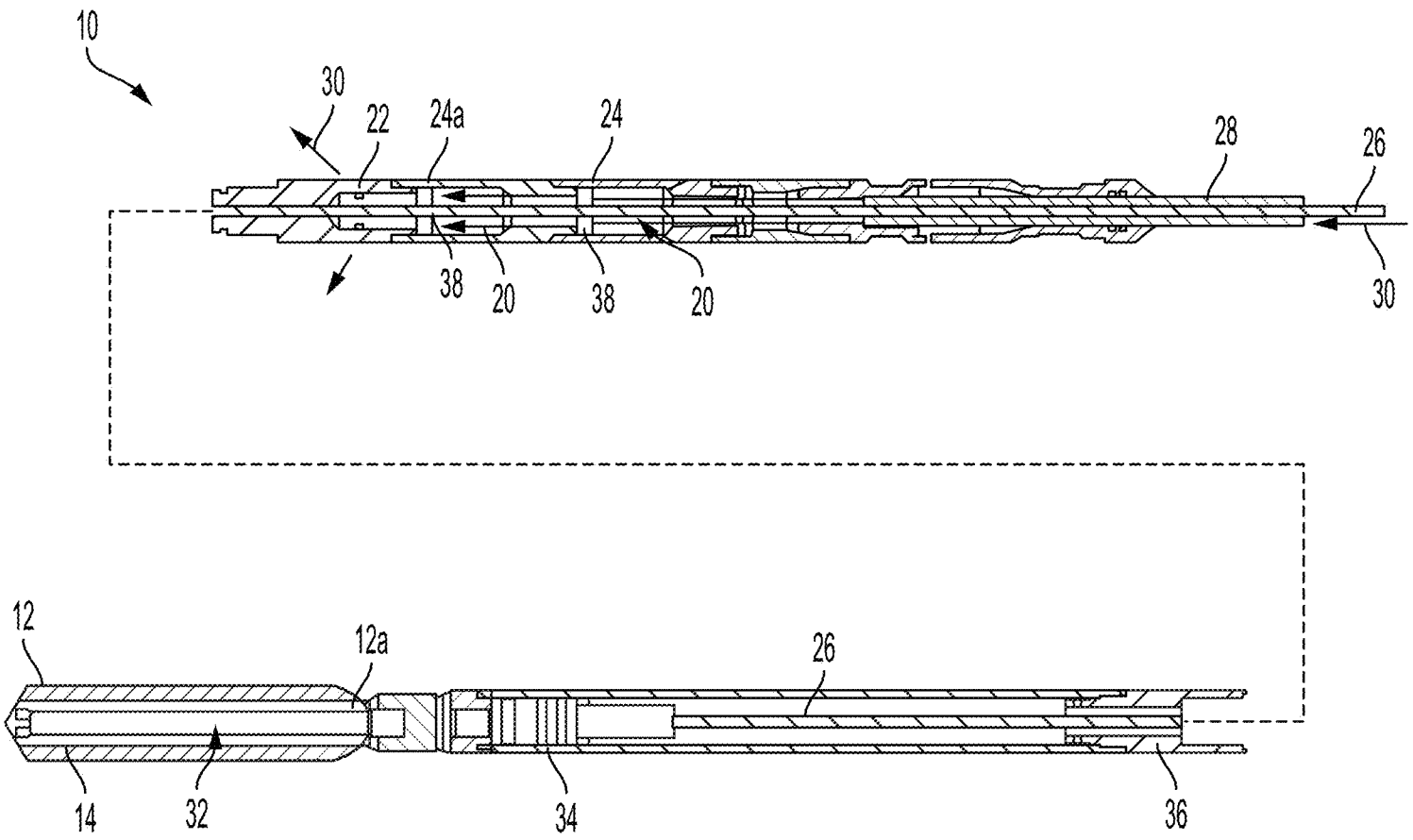
FIG. 2 is a cut-away view of an exemplary coiled tubing heating head tool.

FIGS. 1 and 2 illustrate aspects of an exemplary coiled tubing (CT) deployed heating head tool 10. Tool 10 includes a heating head 12 having a heater 14, a tubular 16 extending from heating head 12 to a tubing connector 18, a fluid passage 20 extending from a discharge port 22 in the tubular 16 through the tubing connector 18, a one-way valve 24 in fluid passage 20, and a power cable 26 electrically coupled to heater 14 and extending through the tubular and the tubing connector. In an exemplary configuration, tubing connector 18 is configured to connected to continuous coiled tubing 28 which conveys power cable 26 and fluid 30. The power cable may be tubing encapsulated conductors (TEC) designed to resist working pressure and exposed media.

The heating head can be of multiple shapes, forms, and sizes, that could or could not have external blades or fins. In an exemplary tool, heater 14 is an expandable heater disposed in an internal cavity 32 of heating head 12. The heater, during the process of heating, expands to provide full contact with the inner walls of the heating head cavity, maximizing the heat transfer by thermal conduction to the external walls of the heating head. An example of the expandable heater is a WATT-FLEX® split-sheath cartridge heater made and sold by Dalton Heating Co., Inc. of Ispwich, Mass. In a non-limiting example, the heater is a 300 W heater. The heater may be capable of heating, for example, to 600 degrees Fahrenheit. The heating head, e.g., the housing, may have a pressure rating of 20,000 psi. The heating head may have a short heating area reducing the electrical energy required to maintain heat during melting operation and increasing efficiency. Electricity can be continuously supplied from a remote location through power cable 26 eliminating the need for a tool located power source (e.g., battery). The heating head can be cold while manipulating and deploying and turned on and off from a remote location, such as a well surface, when desired.

An electrical connector 34 is located at the upper end 12*a* of heating head 12 for connecting power cable 26 to heater 14. A power cable isolation connection 36 located below discharge port 22 seals the power cable and the heating head from the upper tool portion 16*a*. A sub with discharge ports 22 is connected above the power cable isolation connection facilitating discharging fluid pumped through the coiled tubing and tool into a flowline (e.g., wellbore, pipeline).

In an exemplary configuration, power cable 26 extends along central axis 40 of tool 10 and fluid passage in an annular passage around power cable 26. Upper tool section 16*b*, e.g., the fluid passage portion, includes power cable annular seal-offs separating the power cable from the annular flow passage 20. In the illustrated configuration, the power cable annular seal-off is incorporated into one-way valve 24. One-way valve 24 is a pass-through check valve whereby power cable 26 passes through one-way valve 24 and the valve seals 38 around power cable 26. One-way valve 24 may be for example a poppet type valve. An exemplary tool 10 uses a dual poppet valve system to prevent backflow up the coiled tubing while working live well condition, illustrated by first one-way valve 24 and second one-way valve 24*a*. Conventional downhole tools use a bypass method, with a check valve adjacent to a mechanically attached fitting on the bypass cable, increasing tool size, thereby limiting range of suitable intervention applications due to size restrictions. Using a pass-through sealing design, reduces the overall diameter of the downhole assembly.

Figure 3:
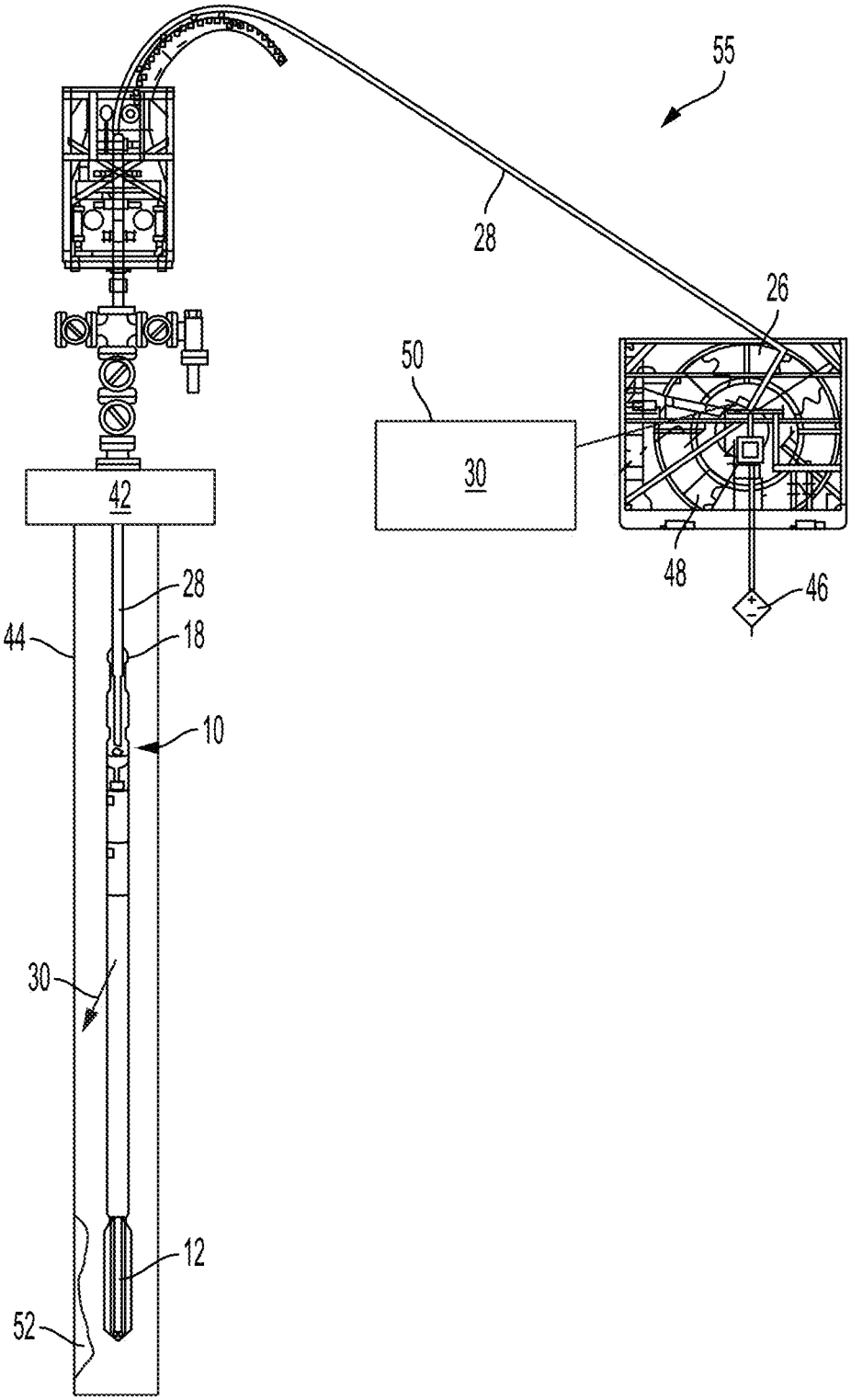
FIG. 3 is an exemplary illustration of a coiled tubing heating head tool system utilized in a wellbore.

FIG. 3 is a schematic illustration of an exemplary CT deployed heating head tool 10 in operation. In this example, CT deployed heating head tool 10 is deployed in a wellbore 42 and more specifically in the production tubing 44, for example, 2⅜-inch tubing or larger. It will be understood by those skilled in the art with benefit of this disclosure that use of the CT deployed heating head tool is not limited to wellbores and production tubing and may be used in other flowline types.

The power cable 26, e.g., TEC, is deployed using a coil tubing system 55 equipped with a tube in tube bypass. At the near end, the coil tubing is connected to the fluid pressure isolation module and the TEC is then attached to the junction box to the rotational spinning contacts. These provide electrical continuity to the fixed non-rotational contacts that are connected to the heater's controller. The controller is powered from the coil tubing system's electric generator/step down transformer. It will be used to turn ON/OFF the heating head, it also provides the means to adjust manually the electrical parameters to a desired or required set point. The TEC will carry the required electrical energy to tool 10 at the far end of the coil tubing. The tool has a mechanical disconnect and check valve system, which among other functions, provide pressure and fluid isolation to the TEC conductor(s) and heating head.

In this example, coiled tubing 28 is 0.75-inch continuous coiled tubing with 0.25-inch power cable 26. Power cable 26 extends from power source 46 exterior of the coiled tubing, through the coiled tubing via a rotating electrical connector 48 to the heater in heating head 12. Fluid 30 can be pumped from a tank 50 into coiled tubing 28, through tubing connector 18 and into the annular fluid passage around the power cable in tool 10. Fluid 30 is ejected from discharge port in tool 10 into production tubing 44 to aid in removing deposits, in particular the melted deposits, from the flowline.

Figure 4:
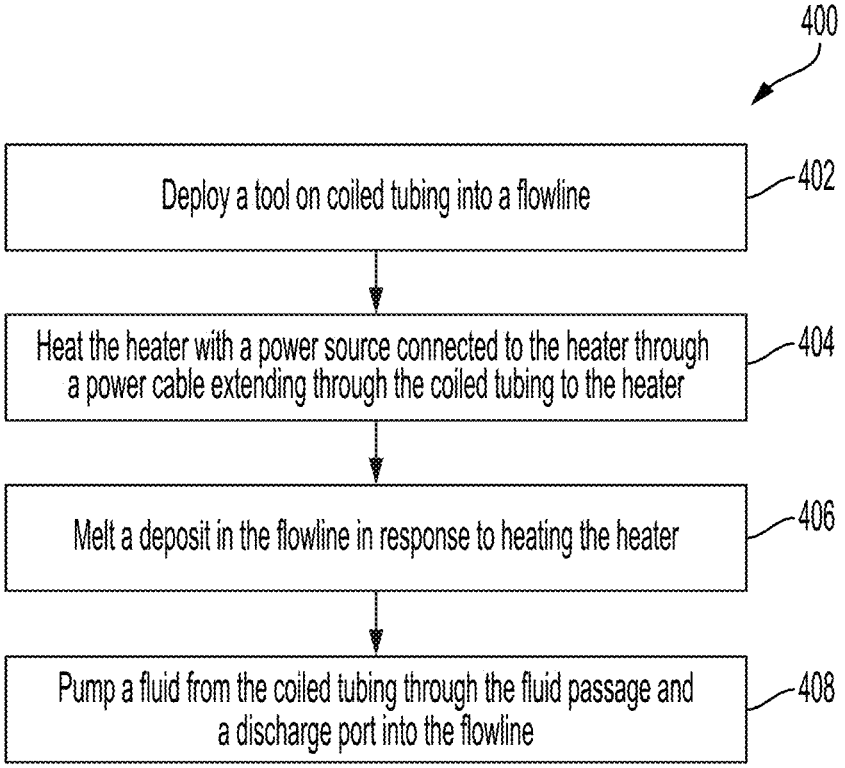
FIG. 4 is a block diagram of a method of using a coiled tubing heating head tool.

FIG. 4 illustrates an exemplary method of using coiled tubing deployed heating head tool 10, which is described with additional reference to FIGS. 1-3. At block 402, tool 10 is deployed on coiled tubing 28 into a flowline 44. Heating head 12 is located adjacent to a deposit 52 and heater 14 is heated, at block 404, via power source 46 coupled to power cable 26 outside of the flowline. Heater 14 may be heated, for example, to 600 degrees Fahrenheit or greater. At block 406, deposit 52 is melted in the flowline in response to heating the heater. Exemplary deposits 52 include paraffin, asphaltene, and hydrates. At block 408 a fluid 30 is pumped from the coiled tubing into annular passage 20 in tool 10, through the one or more check valves 24, and out discharge port 22 into the flowline. The type of fluid may be chosen to facilitate a desired outcome. Example fluids include water, oil, and chemical treatments. The fluid may be used to aid in transporting the melted deposit through the flowline or otherwise removing the deposit from the flowline. For example, the fluid may be a heated liquid that maintains the removed deposit at or above a melting temperature. The discharge ports may be used to spot place a treatment fluid. The fluid can force circulation to remove the deposit.

In an exemplary configuration, the melting action is achieved using an expandable heater inside the cutting head. The exemplary CT deployed heating head tool does not use a tool-located battery or electronics. Continuous or direct power is supplied from one or multiple conductors deployed using a tube-in-tube coiled tubing system to provide simultaneous fluid circulation capabilities. The active melting is achieved using a discrete or single point heating element at the end of the coiled tubing that concentrates the heating power in a small area and reduces the electrical/heating power required, which increases overall efficiency. Through the additional capability of fluid flowback to the surface with proper annular velocity, as soon as material is melted, particularly in a solidly plugged well, the melted solids remain in solution to be returned to the surface providing a thorough clean out and opening of the flowline. An exemplary use is oil wells that present a blockage that can be removed by melting and fluid circulation. The system is designed, for example, for below surface downhole paraffin maintenance/removal in downhole oilfield production tubing. However, the tool and system can be used in other fluid flowlines.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A heating head tool, the tool comprising:
- a heating head comprising a heater;
- a tubular extending from the heating head to a tubing connector;
- a fluid passage extending from the tubing connector to a discharge port in the tubular;
- a one-way valve in the fluid passage permitting fluid flow in a downhole direction from the tubing connector toward the discharge port and blocking the fluid flow in an uphole direction from the discharge port to the tubing connector; and
- a power cable electrically coupled to the heater and extending through the tubular and the tubing connector.

2. The tool of claim 1, wherein the one-way valve is a pass-through check valve whereby the power cable passes through the one-way valve.

3. The tool of claim 2, wherein the pass-through check valve seals around the power cable.

4. The tool of claim 2, wherein the pass-through check valve is a poppet type valve.

5. The tool of claim 1, wherein the power cable extends along a central axis of the tubular and the fluid passage is an annular passage around the power cable.

6. The tool of claim 1, wherein the heater is an expandable heater.

7. The tool of claim 1, wherein the heating head comprises an internal cavity and the heater is an expandable heater located in the internal cavity.

8. The tool of claim 1, wherein the fluid passage is an annular passage around the power cable;
- the power cable passes through the one-way valve; and
- the one-way valve seals around the power cable.

9. The tool of claim 8, wherein the heater is an expandable heater.

10. A coiled tubing heating head tool system, the system comprising:
- a tool connected at a connector to a terminal end of coiled tubing, the tool comprising:
  - a tubular extending from the connector to a heating head comprising a heater;
  - a fluid passage extending from a discharge port in the tubular through the connector into the coiled tubing; and
  - a one-way valve in the fluid passage between the discharge port and the connector, the one-way valve permitting fluid flow in a downhole direction from the coiled tubing and the connector to the discharge port and blocking the fluid flow in an uphole direction from the discharge port to the connector and coiled tubing; and
- a power cable electrically coupled to the heater and extending through the tubular, the connector, and the coiled tubing, to an electrical power source.

11. The tool of claim 10, wherein the one-way valve is a pass-through check valve whereby the power cable passes through the one-way valve and the pass-through check valve seals around the power cable.

12. The system of claim 11, wherein the pass-through check valve is a poppet type valve.

13. The system of claim 10, wherein the power cable extends along a central axis of the tubular and the fluid passage is an annular passage around the power cable.

14. The system of claim 10 wherein the heater is an expandable heater.

15. The system of claim 10, wherein the heating head comprises an internal cavity and the heater is an expandable heater located in the internal cavity.

16. The tool of claim 10, wherein the fluid passage is an annular passage around the power cable;
- the power cable passes through the one-way valve;
- the one-way valve seals around the power cable; and
- the heater is an expandable heater.

17. A method comprising:
- deploying a tool on coiled tubing into a flowline, the tool comprising a tubular extending from a connector secured to the coiled tubing, the tubular extending from the connector to a heating head comprising a heater, a fluid passage extending from a discharge port in the tubular through the connector into the coiled tubing, a one-way valve in the fluid passage between the discharge port and the connector, and a power cable electrically coupled to the heater and extending through the tubular, the connector, and the coiled tubing, to an electrical power source;
- heating the heater with the power source;
- melting a deposit in the flowline in response to heating the heater; and pumping a fluid from the coiled tubing through the fluid passage and the discharge port into the flowline.

18. The method of claim 17, wherein the pumping is simultaneous with the melting.

19. The method of claim 17, wherein the fluid passage is an annular passage around the power cable;

the power cable passes through the one-way valve; and the one-way valve seals around the power cable.

20. The method of claim 17, wherein the heating head comprises an internal cavity and the heater is an expandable heater located in the internal cavity.

* * * * *